US009138883B2

(12) United States Patent
Lin

(10) Patent No.: US 9,138,883 B2
(45) Date of Patent: Sep. 22, 2015

(54) TOOL HANDLE AND TOOL BOX COMPRISING THE SAME

(76) Inventor: Yi-Hung Lin, Taichung (TW)

( * ) Notice: Subject to any disclaimer, the term of this patent is extended or adjusted under 35 U.S.C. 154(b) by 792 days.

(21) Appl. No.: 13/423,569

(22) Filed: Mar. 19, 2012

(65) Prior Publication Data

US 2013/0240391 A1 Sep. 19, 2013

(51) Int. Cl.

| | |
|---|---|
| ***B25B 23/18*** | (2006.01) |
| ***B25F 1/02*** | (2006.01) |
| ***B25H 3/02*** | (2006.01) |

(52) U.S. Cl.

CPC ... *B25F 1/02* (2013.01); *B25H 3/02* (2013.01)

(58) Field of Classification Search

CPC ..... B25B 23/18
USPC ..... 206/349; 81/489; 362/119, 120
See application file for complete search history.

(56) References Cited

U.S. PATENT DOCUMENTS

| | | | | | |
|---|---|---|---|---|---|
| 2,288,093 | A * | 6/1942 | Kaffenberger et al. | ..... | 362/578 |
| 2,525,414 | A * | 10/1950 | Kleinschmidt | ..... | 362/578 |
| 3,717,759 | A * | 2/1973 | Rousseau | ..... | 362/186 |
| 4,283,757 | A * | 8/1981 | Nalbandian et al. | ..... | 362/120 |
| 5,772,308 | A * | 6/1998 | Lin | ..... | 362/119 |
| 5,893,631 | A * | 4/1999 | Padden | ..... | 362/201 |
| 5,967,641 | A * | 10/1999 | Sung et al. | ..... | 362/156 |
| 6,022,121 | A * | 2/2000 | Lin | ..... | 362/119 |
| 2004/0228114 | A1* | 11/2004 | Chen | ..... | 362/84 |
| 2004/0264178 | A1* | 12/2004 | Hsu | ..... | 362/119 |
| 2008/0278930 | A1* | 11/2008 | Wu et al. | ..... | 362/120 |
| 2009/0256319 | A1* | 10/2009 | Seymour et al. | ..... | 279/75 |
| 2010/0296271 | A1* | 11/2010 | Chien | ..... | 362/119 |

FOREIGN PATENT DOCUMENTS

| | | |
|---|---|---|
| TW | M386966 | 8/2010 |

* cited by examiner

*Primary Examiner* — Robert May
*Assistant Examiner* — Bryon T Gyllstrom
(74) *Attorney, Agent, or Firm* — Muncy, Geissler, Olds & Lowe, P.C.

(57) ABSTRACT

A tool box of the present invention comprises a tool handle, a case, and cap. The tool handle comprises a housing, a battery assembly, a luminous source, and a conductive element. The luminous source comprises a first leg and a second leg. One of the anode and the cathode electrically connects to the first leg. A top surface of the cap is formed with an engaging groove. The housing of the tool handle engages in the engaging groove. Wherein either the other one of the anode and the cathode or the second leg electrically connects to the conductive element when a tool inserts to the housing and pushes the conductive element to move to the second position. As such, the tool handle can turn on and off the luminous without disposing any switch. An interior of the case has enough space for receiving tools.

14 Claims, 8 Drawing Sheets

TOOL HANDLE AND TOOL BOX COMPRISING THE SAME

BACKGROUND OF THE INVENTION

1. Field of the Invention

The present invention relates to a tool handle.

2. Description of the Prior Art

To provide enough light in a narrow space for users when they work in the space, conventional tool handles have a bulb which can light up the narrow space and users can work more smoothly.

However, it is inconvenient to turn on and off the bulb by a switch especially working in the narrow space. Secondly, it is easy to be neglected to turn off the bulb after users finish the work, therefore, the power of a battery assembly is wasted.

A conventional tool handle, such as disclosed in TW M386966, resolves the disadvantages hereinabove. The tool handle has two magnetic bodies. The magnetic bodies are adapted to draw a metal screwdriver bit. Thereafter the magnetic bodies and the metal screwdriver bit are connected as a circuit and the battery assembly supplies power to the bulb. At the moment, the bulb can be lit up. Whereby the bulb of the conventional tool handle is turned on and off without a switch.

However, the magnetism of the magnetic bodies is limited. If users' operative force is more than the magnetism of the magnetic bodies, the screwdriver bit will slide so that users hardly operate it, even sliding away from the tool handle and falling down to the ground.

Secondly, if the screwdriver bit has no magnetism, i.e., the material of the screwdriver bit is not selected from the group consisting of Fe, Co, and Ni, it can not be drawn by the magnetic bodies, therefore, the bulb can not be lit up.

Moreover, the conventional tool handle is at most an illuminate device, and needs to draw a metal, rod shaped tool so as to turn on the bulb. On the whole, it belongs to a kind of single function product. As far as current multiple-functions consumer market is concerned, it is lack of competitiveness.

The present invention is, therefore, arisen to obviate or at least mitigate the above mentioned disadvantages.

SUMMARY OF THE INVENTION

The main object of the present invention is to provide a tool handle, which has a luminous source can be turned on and off without a switch, and a tool box comprises the tool handle.

Another object of the present invention is to provide a tool handle, which is easy to hold and operate by hand, and a tool box comprises the tool handle.

To achieve the above and other objects, a tool box of the present invention comprises a tool handle, a case, and cap.

The tool handle comprises a housing, a battery assembly, a luminous source, and a conductive element.

The housing comprises a tool inserting section and a holding section. The inserting section is used for a tool inserting therein. Two ends of the holding section are formed with a first holding portion and a second holding portion respectively. The first and the second holding portions are concave grooves.

The battery assembly is disposed in the housing. The battery assembly comprises an anode and a cathode.

The luminous source is disposed in the housing. The luminous source comprises a first leg and a second leg. One of the anode and the cathode electrically connects to the first leg.

The conductive element is movably disposed in the inserting portion. The conductive element is able to move between a first position and a second position. And the conductive element has a tendency to move towards the first position at any time.

Wherein at least either the other one of the anode and the cathode or the second leg does not electrically connect to the conductive element when the conductive element is in the first position.

Wherein either the other one of the anode and the cathode or the second leg electrically connects to the conductive element when a tool inserts to the inserting portion and pushes the conductive element to move to the second position, whereby the battery assembly, the luminous source, and the conductive element are connected as a circuit so that the luminous source obtains power from the battery assembly and is lit up.

Wherein the cap covers to the case. A top surface of the cap is formed with an engaging groove. The housing of the tool handle engages in the engaging groove.

As such, the tool handle of the present invention can turn on and off the luminous without disposing any switch. The first and the second holding portions are concave grooves so that the tool handle is easy for holding and operating by hand. The hand will not slide away from the present invention. Besides, the tool handle engages on the top surface of the cap so that an interior of the case has enough space for receiving tools.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
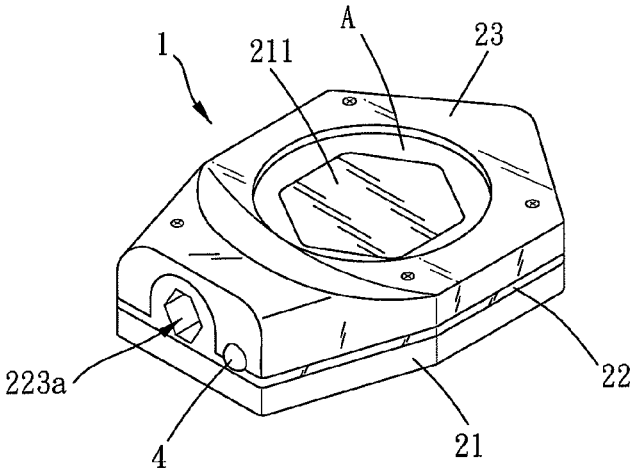
FIG. 1 is a stereogram showing a tool handle.

Please refer to FIG. 1 to FIG. 9 for a preferred embodiment of the present invention. The tool box of the present embodiment comprises a tool handle 1, a case 7, and a cap 8.

Please refer to FIG. 1 to FIG. 4, the tool handle 1 comprises a housing, a battery assembly 3, a luminous source 4, a conductive element 5, and a electric wire 6.

Figure 4:
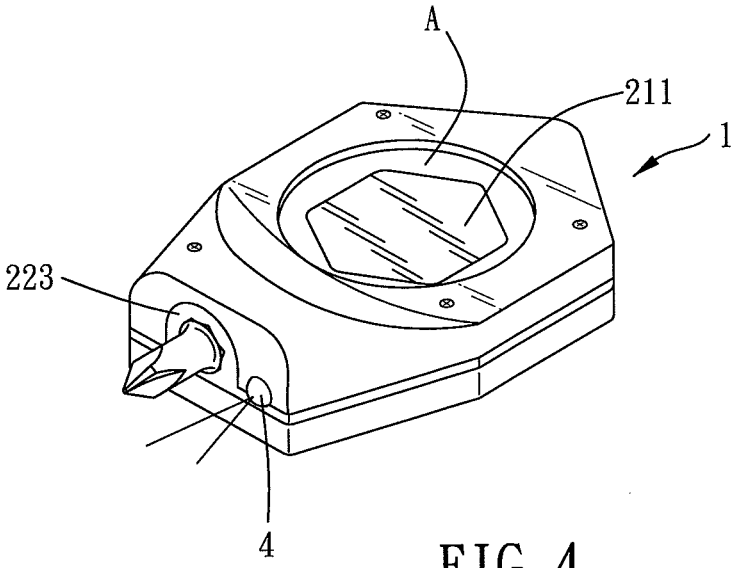
FIG. 4 is a schematic drawing showing a screwdriver bit inserting into a tool inserting recess and switching on a luminous sources.
Figure 4A:
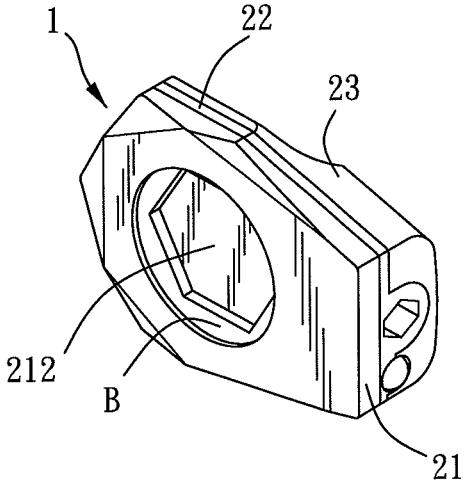
FIG. 4A is a schematic drawing showing the back of a tool handle.

The housing comprises a base 21, an interlayer 22, and an upper cap 23. The interlayer 22 is secured between the base 21 and the upper cap 23. The housing comprises a tool inserting section located at one end thereof and a holding section extending from the inserting section toward an opposite end thereof. A top surface of the housing is formed with a first holding portion 211. A bottom surface of the base is formed with a second holding portion 212. The first and the second holding portions 211, 212 correspond to each other. Preferably, both of the first and the second holding portions 211, 212 are concave grooves and respectively cave in the top and the bottom surfaces of the housing of the holding section. The structure of Said first and second holding portion in one of the embodiments describes hereinafter. The interlayer 22 is formed with a first opening corresponding to the holding section. The upper cap 23 is formed with a second opening 231. When the interlayer 22 is secured between the base 21 and the upper cap 23, the first holding portion 211 is received between the first and the second openings, and the first holding portion 211 is at least exposed from the second opening so that the first and the second holding portions is adapted for holding by hand. Preferably, the first holding portion 211 is formed with a first groove in the middle thereof and the second holding portion 212 is formed with a second groove in the middle thereof. The first and the second grooves are shown in FIG. 1 as hexagonal grooves. The contour of the first groove corresponds to the contour of the second groove. Because the first and the second holding portions are concave grooves, the levels of the first and the second holding portions are respectively lower than the top and the bottom surfaces of the housing of the holding section, as shown in FIG. 4A. Whereby a part of thump and a part of forefinger are respectively received in the first and the second grooves so as to conveniently hold and operate. Besides, each of the first and the second grooves has a side wall A, B. Each side wall A, B is an inclined plane. Whereby a part of thump and a part of forefinger are restricted by the side wall A, B respectively so that both of the thump and the forefinger obtain larger points of application and ensure not to slide out of the first and the second grooves in operation process respectively. As such, the present invention is non-slip and avoid fingers sliding out thereof.

There are many embodiments as to the first holding portion, the second holding portion, and the base. Please refer to FIG. 1 to FIG. 4 for a first embodiment. The first holding portion is a protrusion disposed on the top surface of the base and protruding through the first and the second openings. The second holding portion is a concave groove caved in the bottom surface of the base direct. In a second embodiment (not shown), the bottom surface of the base is formed with a through hole communicating to the first opening. The first and the second holding portions are two ends of an independent member received between the first and the second openings. In a third embodiment (not shown), the first holding portion is an independent member received between the first and the second openings. The second holding portion is the bottom surface of the base.

The first and the second holding portions in said embodiments are adapted for firms showing words, such as their logo, or pictures in the first and the second grooves. Whereby when the present invention is on display in stores, it is more highlighting to attract consumers to buy it. In addition, the firms can make use of this feature to advertise their company and brand. Especially the first and/or the second holding portions of the independent members of the second and the third embodiments can be replaced by a new one. Users can change different logos, which have different pictures, to manifest their mood.

Additionally, each of the base 21 and the upper cap 23 is painted and formed with a color layer as well. After painting, each of the base 21 and the upper cap 23 is light transmissive, semi-light-transmissive, or opaque. Preferably, the base and the upper cap are painted with a manner which is an inside spray painting method so that a pigment is sprayed inside of the base or the upper cap. Whereby when users hold the present invention, the pigment of the base or the upper cap won't be rub off by fingers. As such, the appearance of the present invention can keep in good condition.

Figure 2:
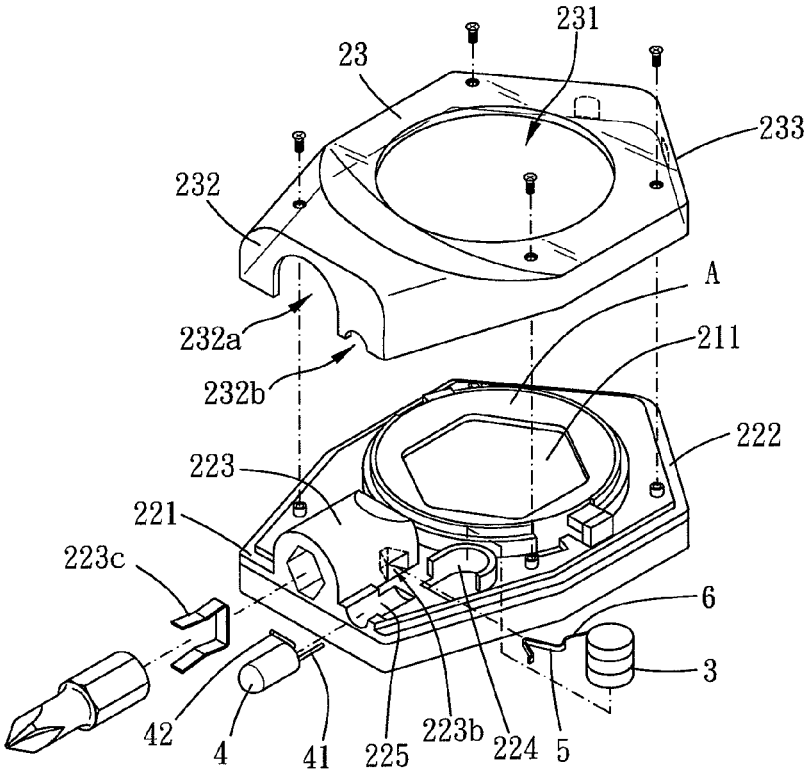
FIG. 2 is a breakdown drawing showing a tool handle.
Figure 3:
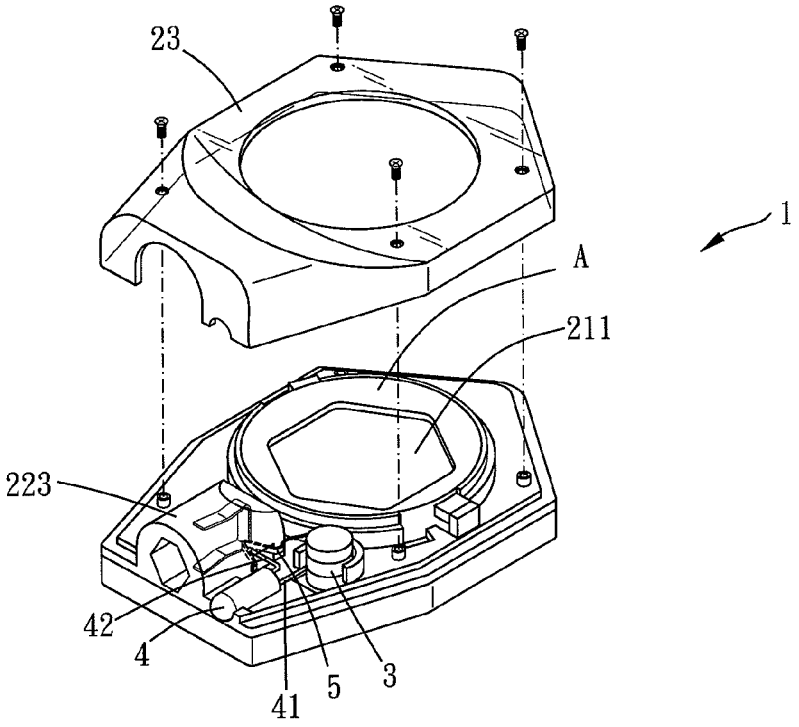
FIG. 3 is a schematic drawing showing how to assemble a tool handle.
Figure 5:
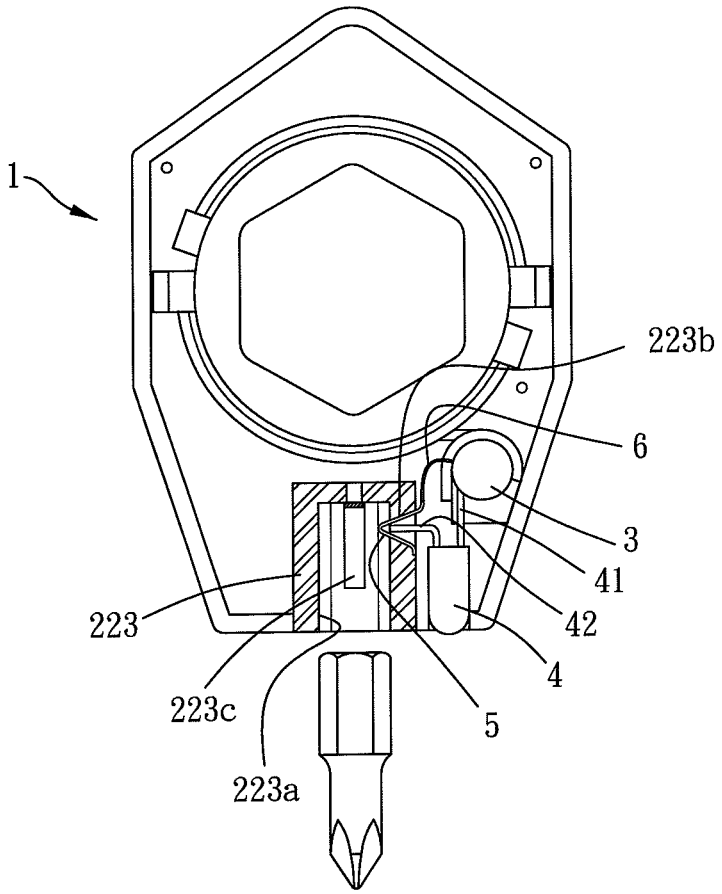
FIG. 5 is a top perspective view of a tool handle, wherein a conductive element is in a first position.

The interlayer 22 comprises a first end 221 corresponding to the tool inserting section and a second end 222 corresponding to the holding section. The first end of the interlayer 22 has an inserting portion 223, a battery recess 224, and a luminous source recess 225. The inserting portion 223 disposed at the first end 221 of the interlayer is caved in and formed with a polygonal tool inserting recess 223*a*. The tool inserting recess 223*a* is used for a tool inserting therein. The tool is a screwdriver bit, as shown in FIG. 2 and FIG. 4 to FIG. 5. Also, the tool is a tool bit, so shown in FIG. 7. The inserting portion 223 is formed with a conductive element recess 223*b* radially. The conductive element recess 223*b* is in communication with the tool inserting recess 223*a*. Preferably, the contour of the conductive element recess 223*b* is trapezoidal in shape. Besides, a periphery of the interlayer 22 is exposed between a periphery of the base 21 and a periphery of the upper cap 23. The interlayer 22 is transparent. In other embodiments, the interlay 22 is completely covered between the base and the upper cap as well. At the present time, the interlayer is transparent, semi-transparent, or non-transparent.

The upper cap 23 comprises a first end 232 corresponding to the tool inserting section and a second end 233 corresponding to the holding section. The first end 232 of the upper cap is formed with a through hole 232*a* and a penetrating hole 232*b*. The inserting portion 223 is received in the through hole 232*a*. The second end 233 of the upper cap is formed with two limiting recesses 234.

Wherein the housing is long and flat. An assembly direction from the base to the upper cap defines a width direction of the housing. An extending direction from the first end of the upper cap to the second end of the upper cap defines a longitudinal direction of the housing. The width of the housing is shorter than the length of the housing. The first and the second holding portions are respectively located at two ends of the width direction of the base. Thus the first and the second grooves are formed at the flattest site of the housing. Whereby users can hold the present invention comfortably and exert easily to work.

The battery assembly 3 is disposed in the housing. More specifically, the battery assembly 3 is received in the battery recess 224 of the interlayer. The battery assembly 3 comprises an anode and a cathode. The battery of the battery assembly is any kind of battery, wherein button cell battery is the best choice.

The luminous source 4 is disposed in the housing. More specifically, the luminous source 4 is received in the luminous source recess 225 of the interlayer. A part of the luminous source 4 penetrates through the penetrating hole 232*b* to outside of the tool handle, as shown in FIG. 4. Wherein the luminous source 4 comprises a first leg 41 and a second leg 42. In this embodiment, the luminous source 4 is a light emitting diode.

The conductive element 5 is movably disposed in the inserting portion 223. More specifically, the conductive element 5 is movably received in the conductive element recess 223*b*. A part of the conductive element 5 inserts to the tool inserting recess 223*a*, as shown in FIG. 5. Wherein the conductive element 5 is able to move between a first position and a second position. More definitely, the conductive element 5 is substantially V shaped. One end of the conductive element 5 is secured on the interlayer 22. The conductive element 5 is a flexible plate made of metal so that it has a tendency to move towards the first position at any time.

Figure 8:
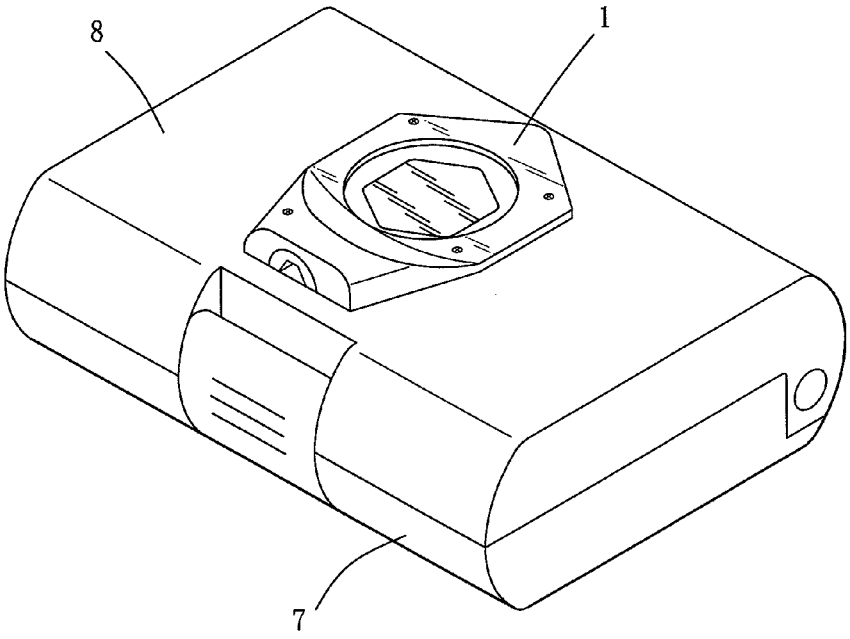
FIG. 8 is a stereogram in accordance with a preferred embodiment.
Figure 9:
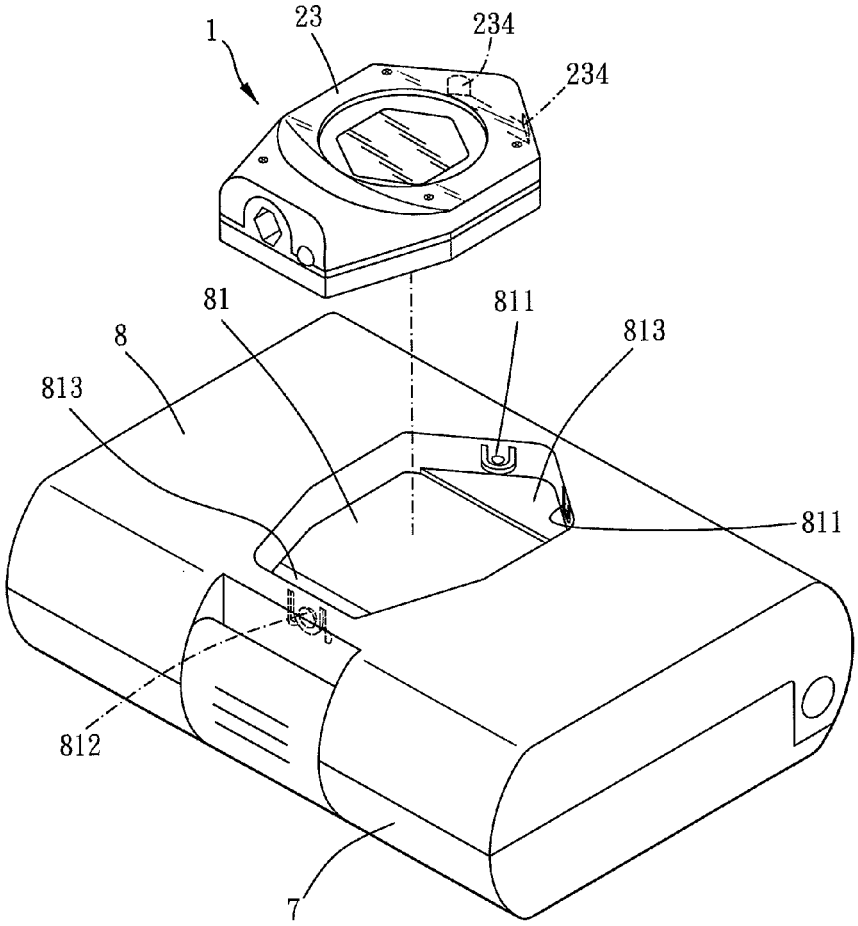
FIG. 9 is a breakdown drawing in accordance with a preferred embodiment.

Please refer to FIG. 8 and FIG. 9. The cap 8 covers to the case 7. A top surface of the cap 8 is formed with an engaging groove 81. The housing of the tool handle engages in the engaging groove 81. More definitely, an inner wall of the engaging groove 81 has two fixing portions 811 and a positioning unit 812 located at a side on the opposite of the fixing portions 811. The fixing portions 811 engage in the limiting recesses of the second end of the upper cap respectively. The positioning unit 812 retains the base 21 fast. In this embodiment, a part of a bottom surface of the engaging groove 81 is hollow so that the engaging groove 81 is in communication with the interior of the case 7. Another part of the bottom surface of the engaging groove 81 is formed with a platform 813 being adapted for the base 21 placing thereon.

Please refer to FIG. 5. Before users operate the present invention, that is, before any tool inserts to the tool inserting recess 223*a*, the conductive element 5 is in the first position. At the moment, the conductive element 5 abuts a wall of the conductive element recess 223*b* so that only a bending part of the conductive element 5 inserts to the tool inserting recess 223*a*. One of the anode and the cathode electrically connects to the first leg 41. At least either the other one of the anode and the cathode or the second leg 42 does not electrically connect to the conductive element 5. As such, the battery assembly 5 does not supply any power to the luminous source 4. The luminous source 4 can not be lit up.

Figure 6:
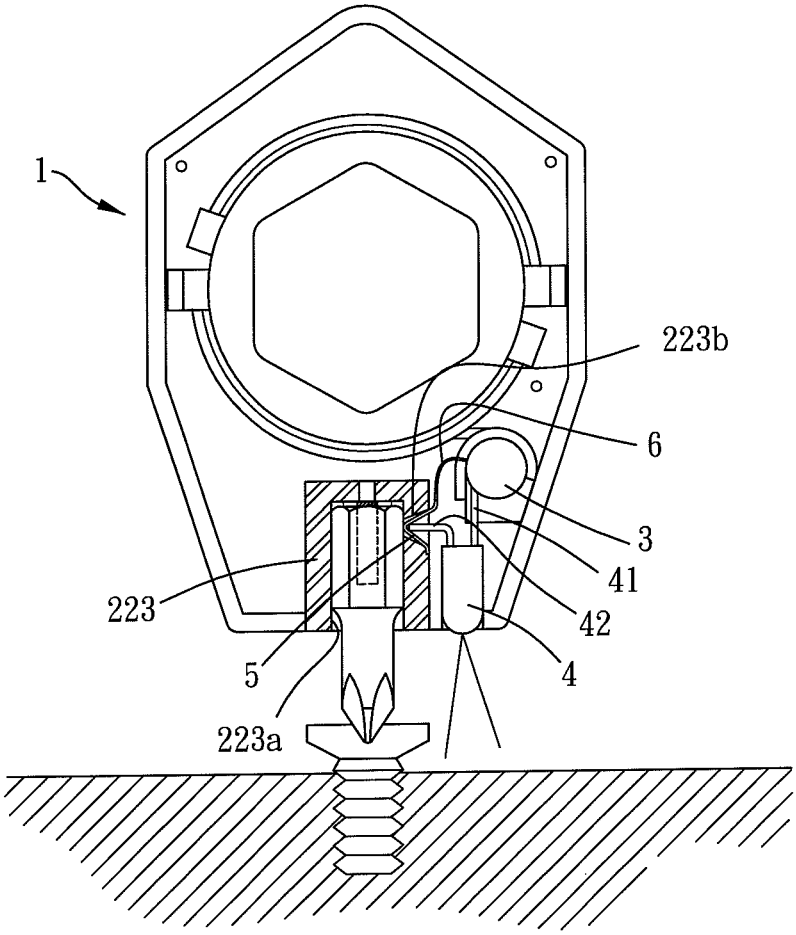
FIG. 6 is a cross-section view showing a screwdriver bit inserting into a tool inserting recess and switching on a luminous source, wherein a conductive element is in a second position.
Figure 7:
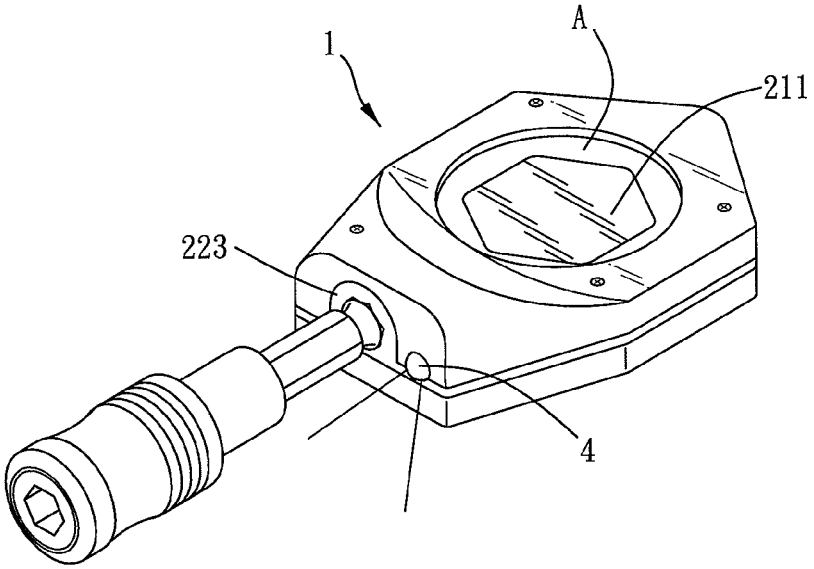
FIG. 7 is a schematic drawing showing a tool bit inserting into a tool inserting recess and switching on a luminous source.

Please refer to FIG. 4, FIG. 6, and FIG. 7. When users insert the tool into the tool inserting recess 223*a* and push the conductive element 5 to move to the second position, either the other one of the anode and the cathode or the second leg 42 electrically connects to the conductive element 5. Whereby the battery assembly 3, the luminous source 4, and the conductive element 5 are connected as a circuit so that the luminous source 4 obtains power from the battery assembly 3 and is lit up.

In this embodiment, when the conductive element 5 is in the first position, the second leg 42 mainly inserts to the conductive element recess 223*b*, but not contacts to the conductive element 5. And one end of the electric wire 6 connects to another end of the conductive element 5. Another end of the electric wire 6 electrically connects to the other one of the anode and the cathode. In other words, the second leg 42 does not electrically connect to the conductive element 5, but the other one of the anode and the cathode electrically connects to the conductive element 5. When the conductive element 5 is in the second position, the conductive element 5 contacts to the second leg 42. Whereby the battery assembly 3, the luminous source 4, and the conductive element 5 are connected as a circuit so that the luminous source 4 obtains power from the battery assembly 3 and is lit up.

After users pull the tool out from the tool inserting recess 223*a*, the conductive element 5 moves back to the first position so that the second leg 42 can not contact the conductive element 5. The circuit is broken. Whereby the battery assembly does not supply any power to the luminous source 4. The luminous source 4 can not be lit up.

The tool handle of the present invention controls the movement of the conductive element 5 and turns on and off the luminous source 4 by the tool inserting into and pulling out from the tool inserting recess 223*a*. As such, the tool handle 1 need not dispose any switch so that the costs of the switch are saved. Users do not worry about the luminous source being hardly turning on when they work in a narrow space. Also, users do not worry about forgetting to turn off the luminous source 4 after they finish the work.

Secondly, the tool inserts to the tool inserting recess 223*a* so the tool is secured very stably and do not slide away from the tool inserting recess. Note that the contour of the tool and the contour of the tool inserting recess 223*a* are non-circular so that they may combine together tightly. Inside of the tool inserting recess 223*a* further has a clip plate 223*c* being used for fixing the tool. Whereby the tool is secured in the tool inserting recess 223*a* tightly so much so that the tool do not slide away from the tool inserting recess. Only if users pull the tool out violently, the tool will be away from the tool inserting recess.

Additionally, the tool handle 1 of the present invention is unlike the conventional tool handle, which has two magnetic bodies and must use a magnetic tool for connecting as a circuit. The tool handle of the present invention is suitable for all kinds of tools, which are made of different material. When the screwdriver bit or the tool tip inserts to the tool inserting recess, the present invention become a multiple-functions product, which act as an illumination device and an assisting tool.

Furthermore, the periphery of the interlayer 22 is exposed between the periphery of the base 21 and the periphery of the upper cap 23. The interlayer 22 is transparent. A part of ray of the luminous source 4 emits through the periphery of the interlayer 22 to outside of the tool handle. Whereby users can see the periphery of the interlayer emitting the ray.

Note that an inside space of the case of the conventional tool box usually is occupied by the tool handle. The case can not receive more tools. The tool handle 1 of the present invention engages on the cap 8, as shown in FIG. 8. Whereby the interior of the case has enough space for receiving more tools or other objects, and is not restricted by the tool handle 1. In addition, when the tool handle 1 engages on the cap 8, the whole tool box has a special view so as to attract the consumers to buy it.

What is claimed is:

1. A tool handle comprising:

a housing, comprising an inserting portion being used for a tool inserting therein;

a battery assembly, disposed in the housing, the battery assembly comprising an anode and a cathode;

a luminous source, disposed in the housing, the luminous source comprising a first leg and a second leg, one of the anode and the cathode electrically connecting to the first leg;

a conductive element, movably disposed in the inserting portion, the conductive element being able to move between a first position and a second position, and the conductive element having a tendency to move towards the first position at any time;

wherein at least either the other one of the anode and the cathode or the second leg does not electrically connect to the conductive element when the conductive element is in the first position;

wherein either the other one of the anode and the cathode or the second leg electrically connects to the conductive element when a tool inserts to the inserting portion and radially pushes the conductive element to move radially to the second position, whereby the battery assembly, the luminous source, and the conductive element are connected as a circuit so that the luminous source obtains power from the battery assembly and is lit up;

wherein the tool handle further includes a clip plate which is substantially U-shaped, the clip plate is inserted in the tool inserting recess for clipping the tool which is inserted from an outside of the housing into the tool inserting recess;

wherein the inserting portion is integrally formed as a part of the housing, and the tool inserting recess is entirely polygonal and has a substantially fixed cross-sectional profile in a direction along which the tool is inserted in the tool inserting recess;

wherein the inserting portion is formed with a conductive element recess radially, the conductive element recess is formed as a through hole in communication with the tool inserting recess, the conductive element is movably received in the conductive element recess, and a part of the conductive element inserts to the tool inserting recess;

wherein the conductive element recess is tapered radially toward the tool inserting recess, the conductive element is substantially V shaped, and two arms of the conductive element elastically abuts a wall of the conductive element recess so that only a bending part of the conductive element inserts to the tool inserting recess when the conductive element is in the first position.

2. The tool handle of claim 1, wherein the housing comprises a base, an interlayer, and an upper cap, the interlayer is secured between the base and the upper cap, the housing comprises a tool inserting section located at one end thereof and a holding section extending from the inserting section toward an opposite end thereof, the inserting portion is disposed in the inserting section, the holding section has a first holding portion and a second holding portion.

3. The tool handle of claim 2, wherein a top surface of the housing is formed with the first holding portion, a bottom surface of the base is formed with the second holding portion, the first and the second holding portions correspond to each other, the interlayer is formed with a first opening, the upper cap is formed with a second opening, the first holding portion is exposed from the first and the second openings when the interlayer is secured between the base and the upper cap so that the first and the second holding portions is adapted for holding by hand.

4. The tool handle of claim 3, wherein the first holding portion is formed with a first groove in the middle thereof, the second holding portion is formed with a second groove in the middle thereof, the contour of the first groove corresponds to the contour of the second groove.

5. The tool handle of claim 4, wherein each of the first and the second grooves has a side wall, each side wall is an inclined plane.

6. The tool handle of claim 2, wherein the interlayer comprises a first end corresponding to the tool inserting section and a second end corresponding to the holding section, the interlayer has the inserting portion, a battery recess, and a luminous source recess, the inserting portion disposed at the first end of the interlayer is formed with a tool inserting recess, the battery assembly is received in the battery recess, the luminous source is received in the luminous source recess.

7. The tool handle of claim 6, wherein the tool handle further comprises an electric wire, one end of the conductive element is secured on the interlayer, one end of the electric wire connects to another end of the conductive element, another end of the electric wire electrically connects to the other one of the anode and the cathode, when the conductive element is in the first position, the second leg inserts to the conductive element recess, but not contacts to the conductive element, when the conductive element is in the second position, the conductive element contacts to the second leg.

8. The tool handle of claim 2, wherein the upper cap comprises a first end and a second end, the first end of the upper cap is formed with a through hole and a penetrating hole, the inserting portion is received in the through hole, a part of the luminous source penetrates through the penetrating hole to outside of the tool handle.

9. The tool handle of claim 2, wherein a periphery of the interlayer is exposed between a periphery of the base and a periphery of the upper cap, the interlayer is transparent.

10. The tool handle of claim 1, wherein the luminous source is a light emitting diode.

11. A tool box, comprising the tool handle of claim 1, the tool box further comprising a case and a cap, the cap covering to the case, a top surface of the cap being formed with an engaging groove, the housing of the tool handle engaging in the engaging groove.

12. The tool box of claim 11, wherein the second end of the upper cap is formed with two limiting recesses, an inner wall of the engaging groove has two fixing portions, the fixing portions engage in the limiting recesses respectively.

13. The tool box of claim 12, wherein the inner wall of the engaging groove has a positioning unit located at a side on the opposite of the fixing portions.

14. The tool box of claim 13, wherein a part of a bottom surface of the engaging groove is hollow so that the engaging groove is in communication with the interior of the case, another part of the bottom surface of the engaging groove is formed with a platform, the platform is adapted for the base placing thereon.

* * * * *